United States Patent [19]

Crepin

[11] 4,441,670

[45] Apr. 10, 1984

[54] GUIDED PROJECTILE

[75] Inventor: Roger Crepin, Paris, France

[73] Assignee: Brandt Armements, Paris, France

[21] Appl. No.: 370,255

[22] Filed: Apr. 20, 1982

[30] Foreign Application Priority Data

Apr. 21, 1981 [FR] France ..... 81 07916

[51] Int. Cl.[3] ..... F41G 7/00

[52] U.S. Cl. ..... 244/3.22; 244/3.21; 239/265.19; 239/265.25; 239/265.29; 60/230; 60/229

[58] Field of Search ..... 244/3.21, 3.22; 239/265.17, 265.19, 265.25, 265.27, 265.2 P, 265.31; 60/264, 271, 254, 261, 39.53, 230, 232, 245, 229

[56] References Cited

U.S. PATENT DOCUMENTS

| | | | |
|---|---|---|---|
| 2,726,510 | 0/0000 | Goddard . | |
| 3,245,620 | 0/0000 | McEwen . | |
| 3,273,825 | 0/0000 | Kerner . | |
| 3,530,886 | 9/1970 | Zoya . | |
| 3,927,693 | 0/0000 | Johnston . | |
| 3,986,683 | 10/1976 | Ellison | 244/3.22 |
| 4,131,246 | 12/1978 | Rotmans | 60/230 |
| 4,375,276 | 3/1983 | Konarski | 239/265.29 |

FOREIGN PATENT DOCUMENTS

| | | | |
|---|---|---|---|
| 64433 | 11/1982 | European Pat. Off. | 244/3.22 |
| 2386802 | of 0000 | Fed. Rep. of Germany . | |
| 2815087 | of 0000 | Fed. Rep. of Germany . | |
| 1232030 | of 0000 | Fed. Rep. of Germany . | |
| 568066 | of 0000 | Fed. Rep. of Germany . | |
| 1291206 | of 0000 | Fed. Rep. of Germany . | |
| 916692 | of 0000 | France . | |
| 1073075 | of 0000 | United Kingdom . | |

*Primary Examiner*—Donald P. Walsh

*Attorney, Agent, or Firm*—Oblon, Fisher, Spivak, McClelland & Maier

[57] ABSTRACT

A guided projectile comprising an energy source supplying a gas flow which feeds two pairs of exhaust nozzles, each pair of nozzles being disposed in the corresponding steering plane. Each of these nozzles is provided with a valve for regulating the relative flowrates of the throughflowing gases; this valve being formed essentially by a pivoting vane hinged about an axis; these vanes are interlocked in pairs and positioned by means of two independent mechanisms formed by a deformable parallelogram, the element 40 being the drive element. According to the invention, the directions of the thrust forces created by the nozzles converge at a point P situated on the axis of the projectile and this point P may merge with the center of gravity G of the projectile.

4 Claims, 6 Drawing Figures

FIG_3-a

FIG_3-b
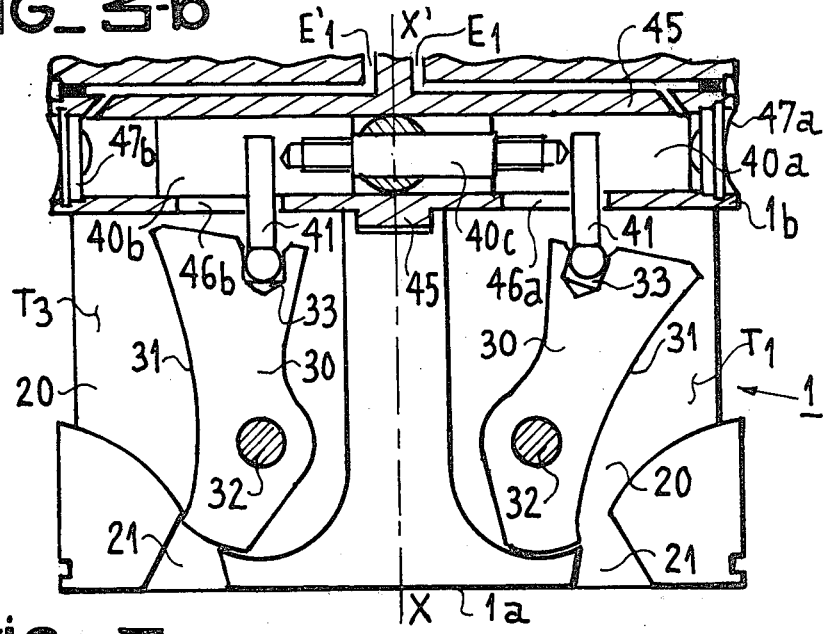
FIG_3-c
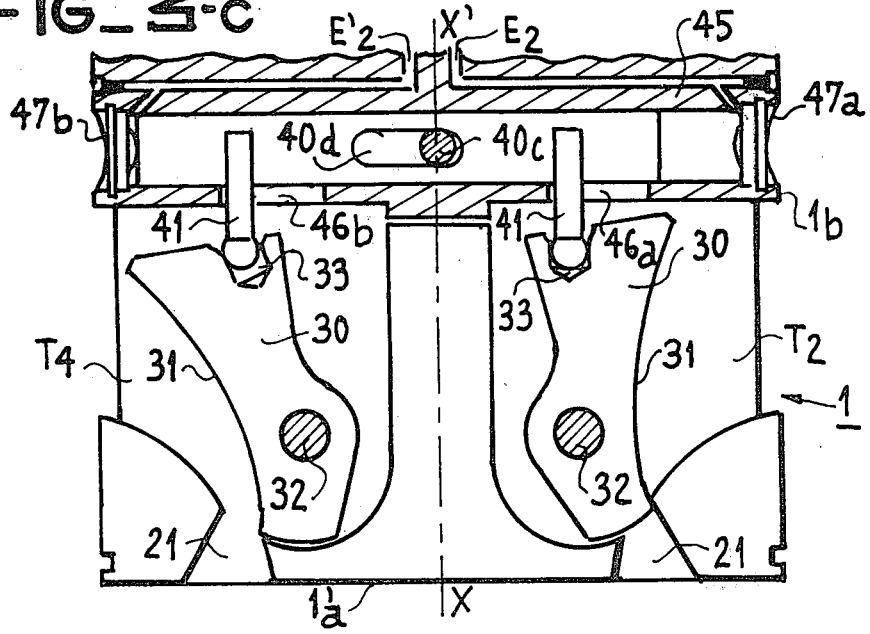
FIG_3-d
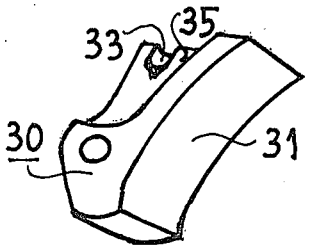

GUIDED PROJECTILE

BACKGROUND OF THE INVENTION

The invention relates to a guided projectile whose flight path may be modified by controllably exhausting lateral gas jets in the steering planes.

A guided projectile, such as a missile, comprises more especially impeller means, guidance means for measuring the trajectory deviations with respect to the position of the target aimed at and steering means for reducing these deviations so as to minimize its travelling distance at right angles to the target. The control of the flight path of a guided projectile, this term covering more especially missiles, rockets and self-driven devices generally etc., may be achieved by application of a lateral thrust force supplied by jets of material whose flow rate and direction may be modified. A thrust force may be obtained from numerous sources of energy, such as liquid propergols or compressed gases which supply adapted steering means. Whereas these steering means are relatively simple and flexible because they may be activated or deactivated intermittently, without danger for the projectile, they present, to a greater or lesser degree, the disadvantage of excessive weight, a certain sensitivity to temperature and, especially, of being not very easily stored over long periods of time. Therefore, in the guided projectile considered here, the energy source required for directional steering and concurrently for maintaining the flight speed is formed by a solid propergol whose combustion supplies a continuous gas flow. A difficulty inherent in the use of a solid propergol is that once the combustion has been started, it must be maintained at a substantially constant pressure, which involves a gas flowrate which varies within a very small range. In fact, an increase in the flowrate of the gases would lead to extinction of the combustion and conversely a reduction of this flowrate would lead to a prohibitive increase of the combustion pressure with, consequently, explosion of the combustion chamber. Another problem which arises, during design of a guided projectile using gas exhaust nozzles, is to provide for the directions of the elementary thrust forces to converge at a single point advantageously situated in the vicinity of the center of gravity of the projectile.

There is already known, from more particularly French patent application No. 77 10755 filed on Apr. 8, 1977, in the name of the Applicant, a guided projectile in which the flight path is modified by exhausting lateral gas jets. In one embodiment described, corresponding to steering in a single plane, the projectile comprises a gas generator, of the solid propergol type, which supplies a pair of fixed diametrically opposed nozzles. To modify the relative flowrate of the gases passing through these two nozzles, it is proposed to dispose, at the outlet of the gas source and placed in the divergent supply conduits of the two nozzles, a single valve comprising a vane pivoting about an axis, situated on the longitudinal axis of the projectile, perpendicularly to the steering plane containing the two nozzles. The configuration of the means for regulating the relative flowrate of the gas throughflow, particularly adapted to steering in a single plane presents numerous advantages, more especially the flowrate of the gas flow is maintained within very narrow limits, the pivoting vane is balanced by the pressure forces of the gases acting on its lateral faces and the means for positioning the vane are of simple construction.

The aim of the invention is a guided projectile of the above described type in which lateral gas jets may be exhausted in two independent mutually orthogonal planes.

SUMMARY OF THE INVENTION

To attain this aim, the invention proposes constructing a guided projectile comprising two pairs of exhaust nozzles orientated in two mutually orthogonal steering planes, each of the nozzles being provided with a valve for regulating the relative flowrate of the gas throughflow; these valves comprise a balanced vane pivoting, about its pivoting axis, under the action of the pressure forces of the gas throughflow; with the pivoting axes of these four valves situated in a plane perpendicular to the longitudinal axis of the projectile, the pivoting vanes are physically connected in pairs to the endmost parts of two fixed jacks.

Another object of the invention is a guided projectile in which the two jacks for positioning the vanes for regulating the relative flowrate of the gas jets are mutually imbricated in their middle part.

Another object of the invention is a guided projectile in which the steering means are combined with the impeller means.

Another object of the invention is a guided projectile in which the effective total passage section of the nozzles is held constant whereas the unitary passage section of the nozzles is modified.

BRIEF DESCRIPTION OF THE DRAWINGS

Other characteristics and advantages of the invention will appear from the following detailed description of one embodiment of a guided projectile in accordance with the invention, given with reference to the accompanying drawings; in these drawings:

The following Figures show one embodiment of a steering section for a guided projectile in accordance with the invention, FIG. 3*a* shows, in a front view, the lay-out of the main elements which form the steering means, FIG. 3*b* shows, in a sectional view, the constructional details of elements corresponding to a first steering plane, FIG. 3*c* shows, in a sectional view, the constructional details of the elements corresponding to the second steering plane, and FIG. 3*d* shows, in a perspective view, a variation of the vane of a valve for regulating the gas flowrate.

DESCRIPTION OF THE PREFERRED EMBODIMENTS

Figure 1:
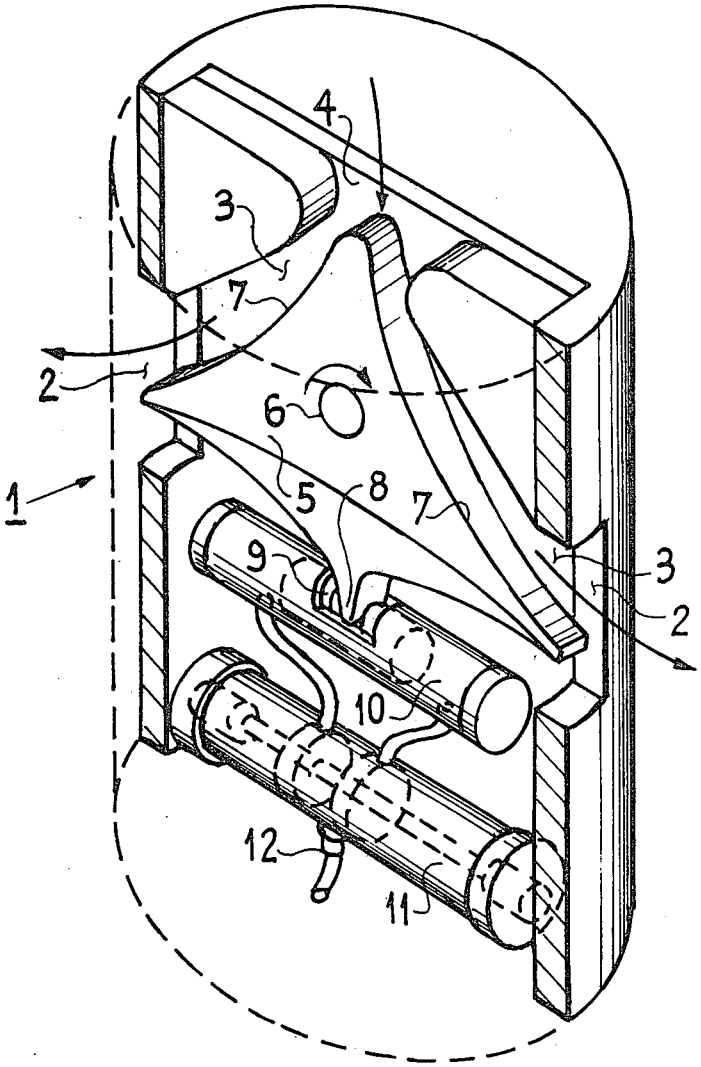
FIG. 1 shows a guided projectile of the prior art equipped with a lateral gas jet steering section.

FIG. 1 relates to the prior art. It shows, in a partial view, a projectile equipped with a steering section using lateral gas jets. This steering section 1 comprises a pair of fixed diametrically opposite exhaust nozzles 2 situated in the steering plane of the projectile. These exhaust nozzles are fed with gas by divergent conduits 3 whose common inlet forms the nozzle throat and receives a continuous gas flow supplied by a primary energy source. The means for regulating the relative flowrate of the gases passing through the nozzles comprise a single valve positioned by means of a pneumatic jack. The regulating valve comprises essentially a pivoting vane 5, triangular in shape, hinged about an axis 6 perpendicular to the plane containing the nozzles. This pivoting vane is partially engaged in the nozzle throat 4 and its lateral faces 7 form one of the walls of the divergent conduits, it is provided with a detent 8 which is housed in an indentation 9 provided in the piston of jack 10. The position of the jack is controlled by a servovalve 11 comprising an air supply inlet 12 and electromagnets energized by electric signals representing steering commands.

Figure 2:
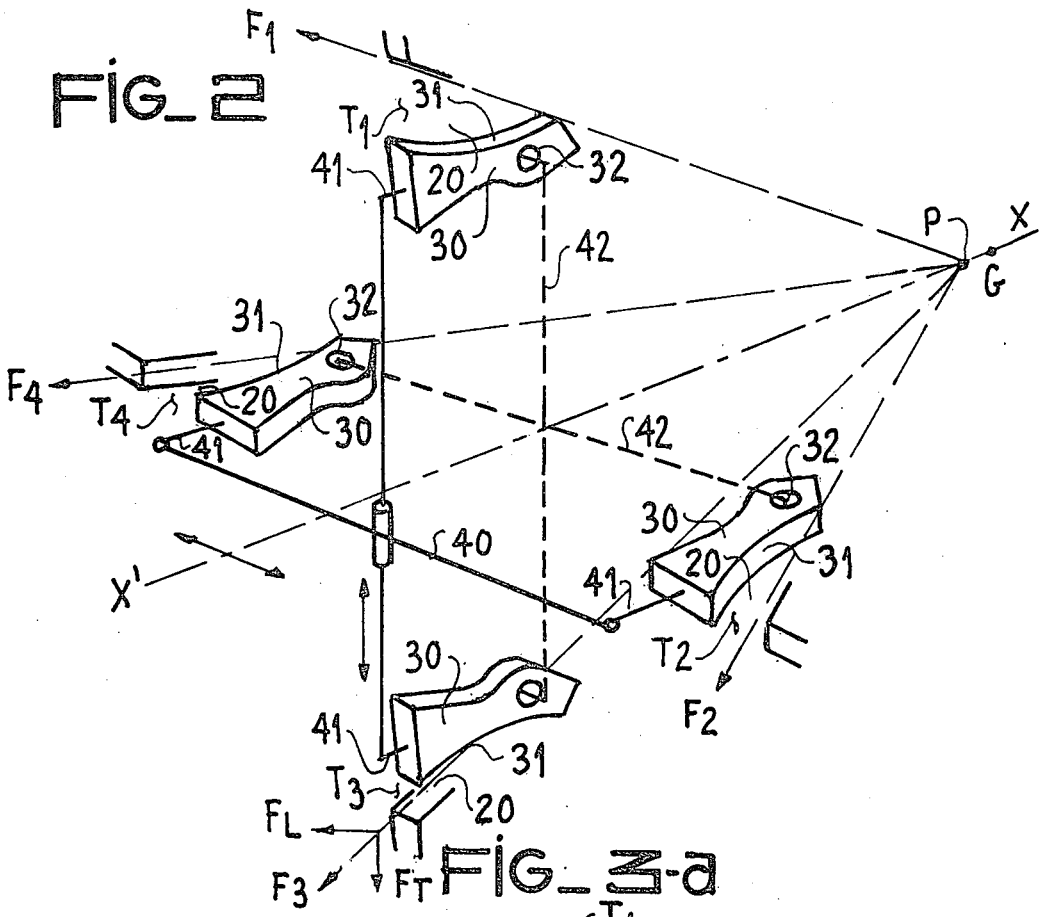
FIG. 2 shows, in schematical form, the basic concepts of a guided projectile in accordance with the invention.
Figure 2:
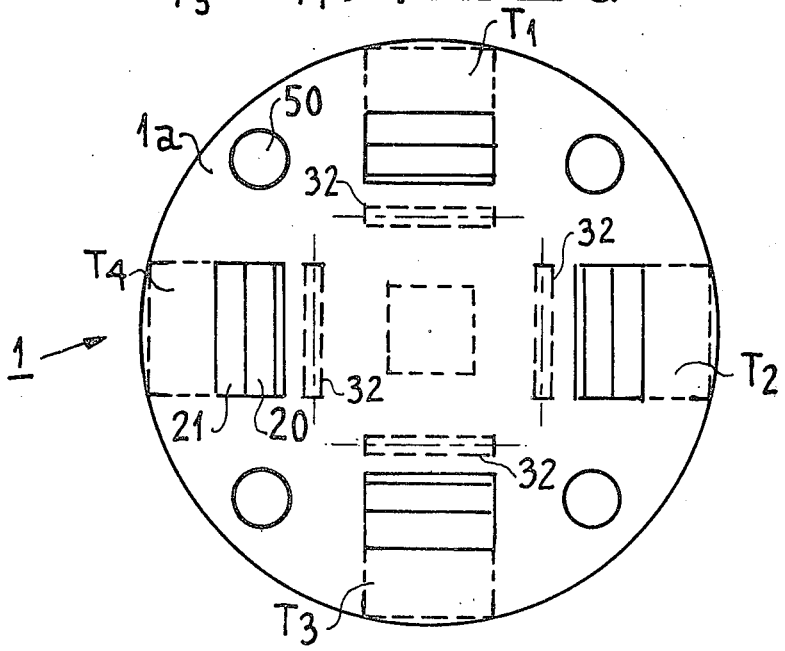

FIG. 2 shows, in schematical form, the basic concepts of the guided projectile in accordance with the invention. This projectile comprises, more especially, a steering section properly speaking, in which are disposed two pairs of fixed nozzles respectively $T_1$, $T_3$ and $T_2$, $T_4$, all identical. By construction, the thrust forces $F_1$ to $F_4$ provided by exhaust nozzles converge at the same point P situated on the longitudinal axis X—X′ of the projectile, this point P merging substantially with the center of gravity G of the projectile. Each pair of diametrically opposite nozzles is situated in the corresponding steering plane, the two steering planes being advantageously orthogonal. Each of the nozzles is fed through divergent conduits 20, rectangular in section, from a gas source not shown which supplies a continuous gas flow resulting from the combustion of a solid propergol placed in a combustion chamber; in accordance with the invention, the gas source may comprise two substantially identical gas generators disposed on each side of the steering section and operating in parallel, through gas conduits disposed parallel to the axis X—X′ of the projectile and between the nozzles.

Each of the four nozzles, and more precisely each of the divergent conduits 20, is provided with a valve for regulating the gas flowthrough rate; these valves being essentially formed by a pivoting vane 30, one of whose lateral faces 31 forms, at least partially, one of the walls of the divergent conduits. The pivoting axes 32 of these vanes are situated in the same plane perpendicular to the longitudinal axis X—X′ of the projectile.

The diametrically opposite vanes are physically interlocked by means of a hinged mechanism forming a deformable parallelogram whose cross arm 40 forms the drive element; the longitudinal arms 41 form the connecting elements, the fourth arm 42 shown by a broken line and passing through the pivoting axes of the vanes being provided by the structure of the projectile itself.

In a preferred embodiment, the exhaust nozzles are inclined to a greater or lesser degree with respect to the longitudinal axis of the projectile, so as to create a thrust force F whose components form the longitudinal $F_L$ and transverse $F_T$ thrust forces for respectively maintaining the flight speed of the projectile and for modifying the flight direction thereof.

In a variation, the transverse arms 40 of the vane operating mechanism are made concurrent by imbrication of their middle part.

FIGS. 3*a* to 3*d* show one embodiment of the steering section of the guided projectile in accordance with the invention. In this embodiment, the four exhaust nozzles are orientated rearwardly of the projectile so as to provide a longitudinal thrust component and the jacks for positioning the valves for regulating the gas flowrates are imbricated in their middle part.

FIG. 3*a* shows a front view of the steering section; this section comprises two elements: a first element 1*a* including the four nozzles with their respective valves and a second element 1*b* carrying the valve positioning jacks.

In this FIG. 3*a* are shown the relative positions of the two pairs of nozzles, respectively $T_1$; $T_3$ and $T_2$, $T_4$, which are disposed at the periphery of the first element 1*a* of the steering section. These nozzles, all identical, have a rectangular section and the divergent conduits 20 open into convergent conduits 21 which form the gas flow inlets. The pivoting axes 32 of the pivoting vanes are situated in the same plane and are parallel to the larger dimension walls of the nozzles.

In this FIG. 3*a* there is also shown the gas passage conduits 50 providing connection between the gas generators situated on each side of the steering section.

FIG. 3*b* shows, in a sectional view, the elements which form the means for steering in a first steering plane. Disposed in the first element 1*a* of the steering section 1 we find:

the two diametrically opposite nozzles $T_1$ and $T_3$ and their divergent conduits 20 and 21, the two pivoting vanes 30 hinged about their pivoting axis 32, the lateral face 31 of these vanes forms one of the walls of the divergent conduits 20; the position of the pivoting axis 32 is such that the direction of the resultant of the forces exerted on the lateral face 31 passes substantially through this pivoting axis; the vanes are provided with an indentation 32 for housing a rod 41 for connection with the corresponding control jack.

Disposed in the second element 1*b* of the steering section 1 we find:

a fixed double-acting jack whose piston 40 is housed in a jack body 45; this jack body comprises two apertures 46*a* and 46*b* allowing free translational movement of the connecting rods 41 and two closure plugs 47*a* and 47*b* serving jointly as abutment for piston 40; piston 40 comprises two cylindrical elements 40*a* and 40*b* connected solidly together by means of a cylindrical element 40*c* of smaller diameter.

In this FIG. 3*b*, one of the vanes is shown in the open position and the other in the closed position; however, it should be understood that these vanes may occupy any intermediate symmetrical position. Furthermore, the jack body comprises two gas inlets $E_1$ and $E'_1$ connected to the output of a servovalve not shown. The pneumatic energy required for operating the jacks may be taken from the gas flow supplied by the gas generators.

FIG. 3*c* shows, in a sectional view, the elements which form the means for steering in the second steering plane. These elements are essentially identical to those described in the preceding figure, the only difference being the construction of piston 40 of the pneumatic jack for positioning the corresponding pivoting vanes. This piston 40 is a cylindrical piece in the middle part of which is provided an opening 40*d* allowing free translational movement of the cylindrical element 40*c* already described with respect to FIG. 3. The gas inlets $E_2$ and $E'_2$ are connected to a second electromagnetic control valve not shown.

FIG. 3*d* shows an embodiment of the vane 30 for reducing the inertia thereof; for this purpose, the non active parts of the vane are hollowed out so as to leave only a stiffening "wing" 35 in which is provided the indentation 33. The pieces subjected to the action of the gases must be made from a refractory material resisting erosion, for example from graphite or molybdenum.

The advantages and characteristics of the invention can now be more clearly seen. In addition to the feature according to which the directions of the elementary thrust forces created by the nozzles converge at a single point, the projectile may be steered independently in two steering planes. Furthermore, the mechanism for regulating the gas flow rates is extremely robust and compact.

The invention is not strictly limited to the embodiment described and shown; for example, indentation 30 provided in vanes 30 may be instead formed in the pistons 40 of the pneumatic jacks and the rods 41 may be integral with the vanes. According to one variation, pistons 40 may comprise a rack driven by a bi-directional rotary motor of the electric or pneumatic type and means may be provided on these pistons for coupling a positional sensor. Similarly, the profiles of the nozzles of the gas conduits and of the vanes have only been given by way of illustration and are in no wise limiting. Finally, it is not at all indispensable for the thrust center P of the exhaust nozzles to merge with the center of gravity G of the projectile.

The invention applies more especially to missiles stabilized against rolling or self-rotation.

I claim:

1. A guided projectile comprising more especially a source of energy supplying a gas flow and two pairs of mutually orthogonal lateral nozzles, each of these nozzles being provided with a valve for regulating the gas throughflow, wherein each valve comprises essentially a pivoting vane one of whose faces forms a wall of the nozzle and the vanes corresponding to each pair of nozzles are interlocked and positioned by means of two parallelogram mechanisms whose transverse elements are the drive elements.

2. The projectile as claimed in claim 1, wherein the drive elements of the parallelogram mechanisms are situated in the same plane, by imbrication of their middle part.

3. The projectile as claimed in claim 1, wherein the drive element of the parallelogram mechanisms is a sliding piston housed in a pneumatic double-acting jack body.

4. The projectile as claimed in claim 3, wherein the sliding piston of a first parallelogram mechanism comprises two cylindrical pieces connected together by a cylindrical piece of smaller diameter and the sliding piston of the second parallelogram mechanism comprises a cylindrical piece in the middle part of which is provided a rectangular opening.

* * * * *